US005608437A

United States Patent [19]

Iwata et al.

[11] Patent Number: 5,608,437

[45] Date of Patent: Mar. 4, 1997

[54] INK CONTAINER AND INK JET RECORDING APPARATUS USING SAME

[75] Inventors: Kazuo Iwata; Masanori Takenouchi, both of Yokohama; Kenjiro Watanabe, Tokyo; Toshihiko Ujita, Yamato; Torachika Osada; Kazuhiro Nakajima, both of Yokohama; Hidemi Kubota, Komae; Yasuo Kotaki, Yokohama; Keiichiro Tsukuda, Kawasaki; Yohei Sato; Takashi Saito, both of Yokohama, all of Japan

[73] Assignee: Canon Kabushiki Kaisha, Tokyo, Japan

[21] Appl. No.: 976,447

[22] Filed: Nov. 13, 1992

[30] Foreign Application Priority Data

Nov. 18, 1991 [JP] Japan ..... 3-329546

[51] Int. Cl.[6] ..... B41J 2/175; B65D 35/10

[52] U.S. Cl. ..... 347/86; 222/107

[58] Field of Search ..... 346/140 R; 347/86, 347/87, 94; 222/147, 105, 107; 220/8

[56] References Cited

U.S. PATENT DOCUMENTS

| | | | |
|---|---|---|---|
| 3,592,360 | 7/1971 | Aleck | 222/107 X |
| 4,313,124 | 1/1982 | Hara | 347/57 |
| 4,345,262 | 8/1982 | Shirato et al. | 347/10 |
| 4,383,263 | 5/1983 | Ozawa et al. | 347/30 |
| 4,388,630 | 6/1983 | Osaki et al. | 347/85 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,599,625 | 7/1986 | Terasawa et al. | 347/87 |
| 4,608,577 | 8/1986 | Hori | 347/66 |
| 4,631,558 | 12/1986 | Hara | 347/94 X |
| 4,689,642 | 8/1987 | Sugitani | 347/87 |
| 4,723,129 | 2/1988 | Endo et al. | 347/56 |
| 4,740,796 | 4/1988 | Endo et al. | 347/56 |
| 4,865,211 | 9/1989 | Hollingsworth | 220/8 |
| 5,040,001 | 8/1991 | Dunn et al. | 347/86 |
| 5,069,368 | 12/1991 | Godard et al. | 222/321.9 |
| 5,283,593 | 2/1994 | Wehl | 346/140 R |

FOREIGN PATENT DOCUMENTS

| | | | |
|---|---|---|---|
| 0174817 | 3/1986 | European Pat. Off. | B41J 3/04 |
| 0375383 | 6/1990 | European Pat. Off. . | |
| 3829741 | 3/1989 | Germany . | |
| 54-056847 | 5/1979 | Japan . | |
| 59-098857 | 6/1984 | Japan . | |
| 59-123670 | 7/1984 | Japan . | |
| 59-138461 | 8/1984 | Japan . | |
| 59-145157 | 8/1984 | Japan | 347/44 |
| 60-071260 | 4/1985 | Japan . | |
| 60-204355 | 10/1985 | Japan . | |
| 61-141562 | 6/1986 | Japan . | |
| 0004954 | 1/1988 | Japan | B41J 3/04 |
| 188829 | 8/1992 | Taiwan . | |

*Primary Examiner*—John E. Barlow, Jr.
*Assistant Examiner*—David Yockey
*Attorney, Agent, or Firm*—Fitzpatrick, Cella, Harper & Scinto

[57] ABSTRACT

An ink container includes a cylindrical member having a closed end and an opposite open end; and a flexible member covering the open end of the cylindrical member to define an ink containing portion. The flexible member has a bottom portion and a bent portion that is movable along an internal surface of the cylindrical member with consumption of the ink therein, wherein the bottom portion is less easily deformable than the bent portion and movement of the bent portion is irreversible.

10 Claims, 10 Drawing Sheets

INK CONTAINER AND INK JET RECORDING APPARATUS USING SAME

FIELD OF THE INVENTION AND RELATED ART

This invention relates to an ink container usable with an ink jet recording apparatus, copying apparatus facsimile machine or the like, and a recording head unit using the ink container and a recording apparatus using the same. In an ink jet recording apparatus, it is desired that the ink is prevented from leaking out through an ink ejection outlet, while permitting smooth ink supply thereto for recording operation. The following types are known.

(a) As shown in FIG. 17, a container opening is covered by a flexible member 200 having a side wall having a wall thickness of t1 and a bottom wall having a thickness t2. With reduction of the internal pressure, the flexible member 200 contracts the container (Japanese Laid-open Patent Application No. 98857/1984).

(b) As shown in FIGS. 18A and 18B, a movable wall is disposed in a container 201, the wall moving toward the ejection outlet 203 in accordance with the consumption of the ink through the ejection outlet. In this case, the negative ink pressure is established by the friction force at the interface between movable wall and the inside surface of said container. In FIG. 18A, the movable wall is provided with an o-ring 202, and in FIG. 18B, the movable wall is in the form of an elastic diaphragm 304 (Japanese Laid-open Patent Application No. 204355/1985). In above case (a), the opening of the container is covered by an elastic flexible member, which collapses in accordance with vacuum provided by the ink consumption. When the ink is consumed to a certain extent, the deformation of the flexible member is significant with the result that further deformation becomes difficult. Then, the vacuum becomes very large. It may be possible that the ink is not supplied any more. The deformation of the flexible member starts at the lateral portions, and therefore, the flexible member does not deform adjacent the opening where the flexible member is mounted with the result of incapability of ink supply. The inventors have found that the use efficiency of the ink in the type (a), is as small as 50% at the maximum. Additionally, if the container is separable from a member having ejection outlets and if they are separated, the restoring force of the flexible member is liable to cause the air to be introduced into the container. If this occurs, the subsequent ink ejection is not in good order, and ink may stop due to the block by the air.

U.S. Pat. No. 5,040,001 proposes in order to improve the ink use efficiency that the lateral side wall of the flexible member is given such different thicknesses that the flexible member collapses first at the portion having a smaller thickness. However, since the structure at the opening where the flexible member is mounted, is similar to above-discussed (a), the use efficiency is not so much improved. In addition, if the thin portion deforms unevenly, or if the portion opposite from the opening deforms inwardly to collapse, the vacuum becomes uneven, or the vacuum increases with a large volume of the ink remaining therein even to the extent that the ink is not supplied any more. This may reduce the use efficiency.

In the case of (b), in order to maintain the sealing between the movable wall and the ink container and in order to prevent tilting of the movable wall, it is required to increase the rigidity of the o-ring or the diaphragm or to increase the thickness of the o-ring or the diaphragm so as to provide a larger contact area with the ink container. As a result, the friction force between the movable wall and the inside surface of the ink container is increased. Then, the starting force required to bring the movable wall from rest state to a moving state is large. It is therefore difficult to adjust the ink vacuum control with high accuracy.

SUMMARY OF THE INVENTION

Accordingly, it is a principal object of the present invention to provide an ink container, a recording head using the same and a recording apparatus using the same, wherein the internal pressure of the container can follow a small amount of ink consumption.

It is another object of the present invention to provide an ink container, a recording head using the same and a recording apparatus using the same, wherein the introduction of the air into the container is effectively prevented.

According to an aspect of the present invention, there is provided an ink container comprising: a cylindrical member having a closed end and an opposite open end; a flexible member covering the open end of said cylindrical member to define an ink containing portion; said flexible member having a bent portion movable along an internal surface of said cylindrical member with consumption of the ink therein, wherein movement of said bent portion is irreversible.

The external surface of the flexible member may be treated for lubrication; the periphery of the flexible member may be fixed to an opening side end of the external cylindrical member; or the periphery of the flexible member may be fixed to a bottom wall. Furthermore, a cover may be disposed outside the flexible member, the cover having an air vent.

With the consumption of the ink, the internal pressure reduces to produce a vacuum. The negative pressure deforms the flexible member, and bent portion advances toward the bottom plate along the inside surface of the container. At this time, the bottom portion less easily deforms than the outer wall and the inner wall, and they maintain the initial configuration while the bent portion advances. That is the flexible member deforms irreversibly. The ink containing volume of the ink container defined by the outer cylinder, bottom wall and the flexible member, reduces by the amount corresponding to the ink consumption.

DETAILED DESCRIPTION OF THE PREFERRED EMBODIMENTS

Referring to the accompanying drawings, the description will be made as to the embodiments of the present invention.

Figure 1:
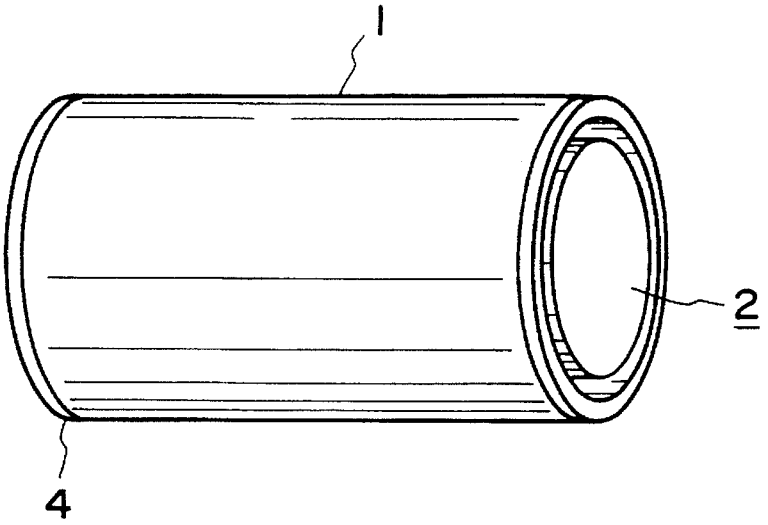
FIG. 1 is a perspective view of an ink container according to a first embodiment of the present invention.
Figure 2:
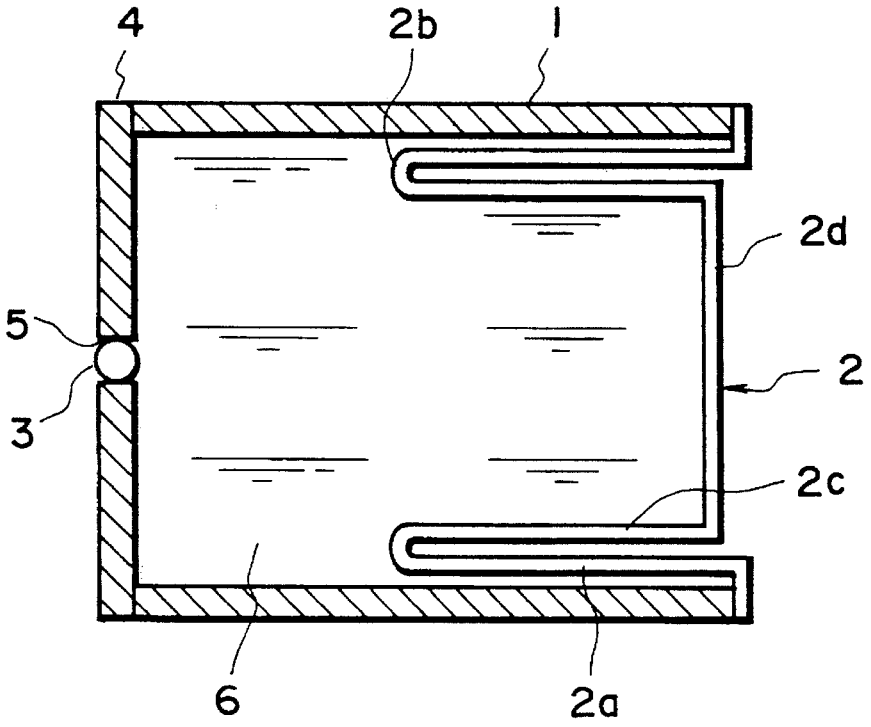
FIG. 2 is a sectional view thereof.

Referring to FIG. 1, there is shown a perspective view of an ink container according to a first embodiment of the present invention, and FIG. 2 is a sectional view thereof.

As shown in FIGS. 1 and 2, the ink container of this embodiment comprises an outer cylindrical member 1, one end of which is closed by a bottom plate 4. The other end is open but is closed by a flexible member 2 made of rubber, soft plastic material. The bottom plate 4 is provided with a discharge opening 5 for supplying or dispensing the ink. The opening 5 is closed by a ball as closing means, when the container is not used.

The flexible member 2 is fixed to the end surface of an opening of the outer cylinder 1 at the outer periphery thereof. The flexible member 2 is bent and extends toward the bottom of the cylinder along the internal surface of the outer cylinder 1. It comprises an outer portion 2*a* extending from the fixed portion toward the inside of the cylindrical member 1 along the internal surface thereof, a or bent back portion 2*b* where the flexible member is bent back substantially at the longitudinal center of the cylindrical member 1, an inner portion 2*c* extending from the bent portion 2*b* along the outer portion 2*a* back to the neighborhood of the open end of the outer cylindrical member 1, and a bottom portion 2*d* in the form of an disk extending from the inner portion 2*c*.

In FIG. 2, the configuration of the flexible member 2 is schematically shown. The bent portion 2*b* may have a larger radius of curvature depending on the nature of the material thereof.

Figure 3:
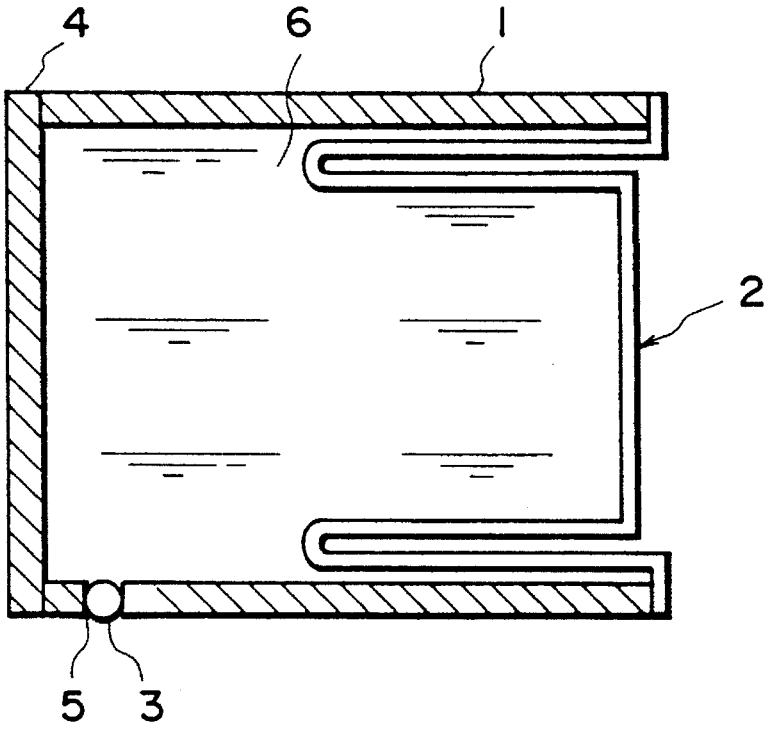
FIG. 3 is a sectional view of a modified ink container of the first embodiment.
Figure 4:
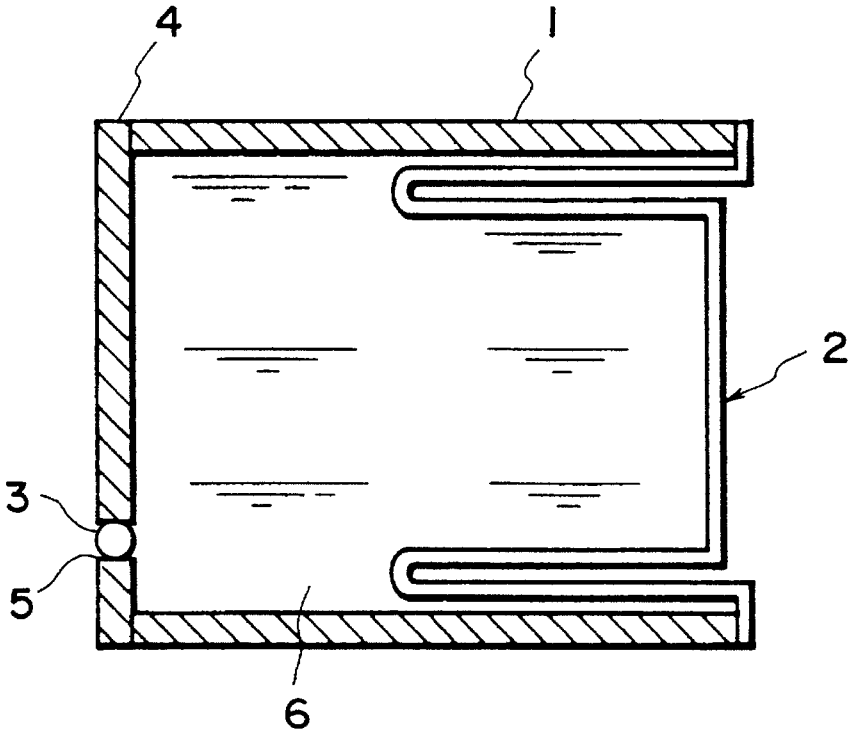
FIG. 4 is a sectional view of another modified ink container of the first embodiment.

FIGS. 3 and 4 show modifications of the first embodiment. In FIG. 3, the discharge opening 5 is formed in the cylindrical portion of the cylindrical member 1 adjacent the bottom plate. In FIG. 4, the discharge opening is formed in the bottom plate adjacent to a periphery.

By disposing the discharge opening 5 not at the center of the bottom plate but at a lower part thereof in use, the ink can be concentrated to the position adjacent the discharge opening by the gravity, and therefore, the ink supply is further improved.

Figure 5:
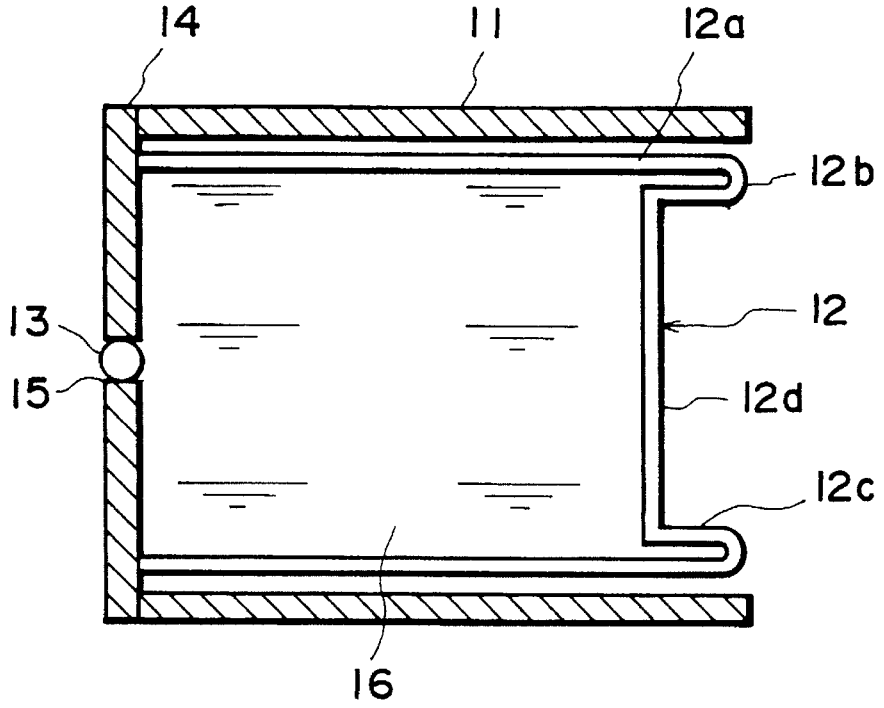
FIG. 5 is a sectional view of an ink container according to a second embodiment of the present invention.

Referring to FIG. 5, there is shown a container according to a second embodiment in cross-section. An edge portion of the flexible member 12 is fixed to a bottom plate 14 of the outer cylindrical member 11. The flexible member 12 comprises an outer portion 12*a* extending along the internal surface of the open end of the cylindrical member 11 to the neighborhood of the cylindrical member 11, a bent portion 12*b* where the flexible member 12 extends back adjacent the open end of the cylindrical member 11, an inner portion 2*c* extending from the bent portion 12*b* along the outer portion 12*a*, and a bottom portion 2*d* in the form of a disk and extending from the inner portion 2*c*. This ink container is the same as that of the first embodiment in the other respects.

Figure 17:
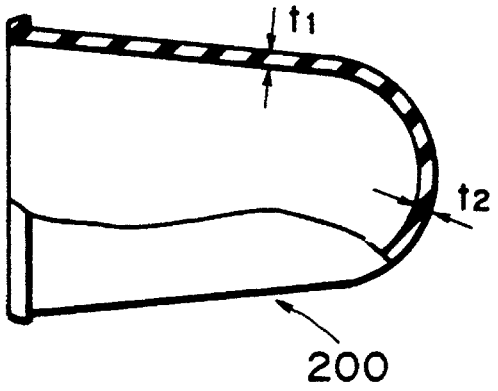
FIG. 17 PRIOR ART
FIG. 17 is a partly sectional side view of a flexible member Used in a conventional ink container.
Figure 18A:
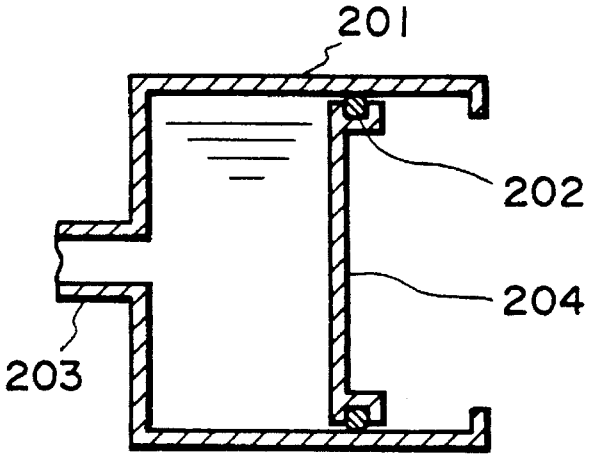
FIG. 18A PRIOR ART
FIG. 18A shows another conventional ink container having a movable wall with an o-ring.
Figure 18B:
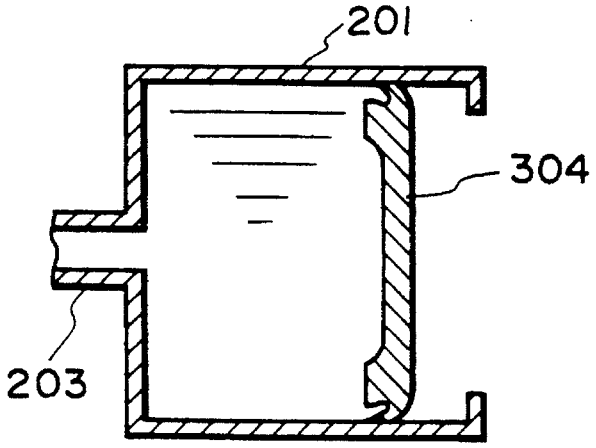
FIG. 18B PRIOR ART
FIG. 18B shows a further conventional ink container having a movable diaphragm.

In the present embodiment, the open end of the flexible member 12 is connected to the bottom plate of the cylindrical member 11. In this sense, the container looks close to the prior art container shown in FIG. 17. Therefore, there is a probability that the outer portion 12*a* first collapses before motion of the bottom portion 12*d*. In view of this, there is provided a bonding material or the like which provides very weak bonding strength, between the outer portion of the flexible member and the inside surface of the outer cylindrical member 11. This is effective to force the bottom portion of the flexible member 12 move first. Thus, the inward collapse of the outer portion of the flexible member 12 which is possible as a result of increased vacuum due to the consumption of the ink, can be effectively prevented, and therefore, the stabilized ink supply is accomplished. In addition, the force required for peeling the outer portion 12*a* of the flexible member 12 from the inside surface of the cylindrical member 11, is effective to provide the vacuum to the ink, and therefore, the ink leakage can be properly prevented. By adjusting the force required to peel the outer portion 12*a* of the flexible member 12 off the inside surface of the outer cylindrical member 11, the vacuum produced in the container can be adjusted.

Figure 6:
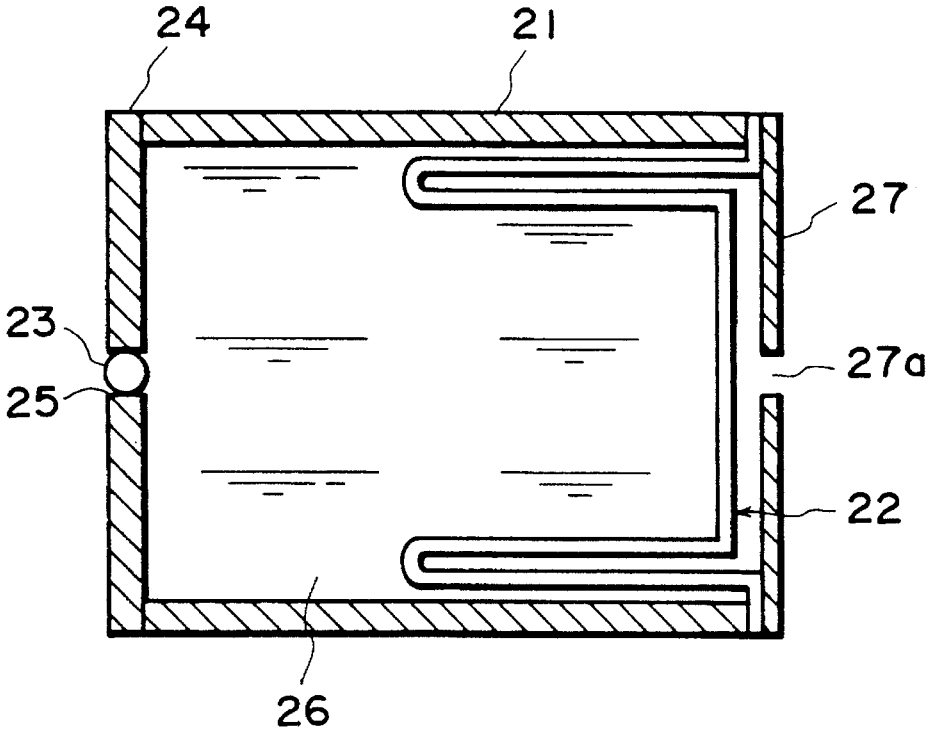
FIG. 6 is a sectional view of an ink container according to a third embodiment of the present invention.

FIG. 6 shows a third embodiment. In this embodiment, the open end of the outer cylindrical member 21 having a flexible member 22 with the structure similar to that of FIG. 1 is covered with a cap 27 having an air vent 27*a*.

By the provision of the cap or cover 27 having the air vent 27*a*, the bottom portion of the flexible member 22 is properly protected from external action. Therefore, unintended pressure application to the flexible member with the result of ink leakage, can be prevented. Additionally, the ink supply using the flexible member can be stabilized.

FIGS. 7–10 show modifications of the third embodiment described in conjunction with FIG. 6. The closing means for the discharge openings formed in the bottom plate, are different. These closing means may be used with the first and second embodiment as well as the third embodiments.

Figure 7:
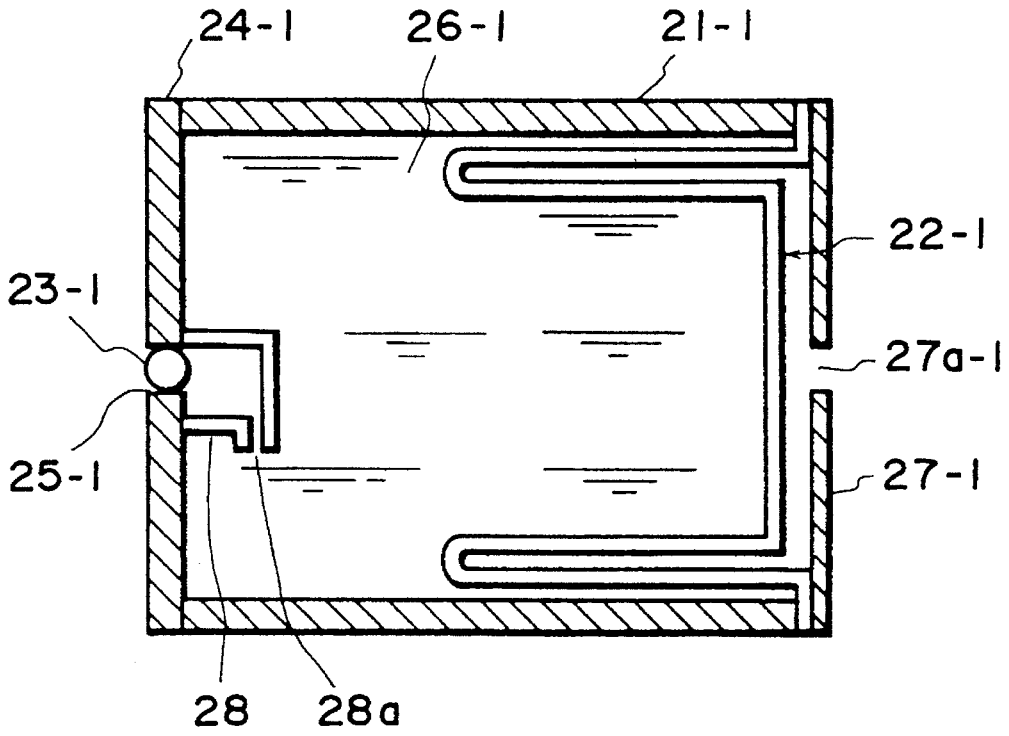
FIG. 7 is a sectional view of an ink container according to first modification of the third embodiment.

In FIG. 7, the discharge opening 25-1 formed in the bottom plate 24-1 is closed by a ball plug 23. To the inside of the bottom plate 24-1, a swing-proof means 28 in the form of a box having an opening 28*a* permitting ink passage, is mounted so as to enclose the discharge opening 25-1. In this embodiment, even if the ink container receives impact, the swing-proof means 28 is effective to prevent ink leakage through the discharge outlet 25-1.

Figure 8:
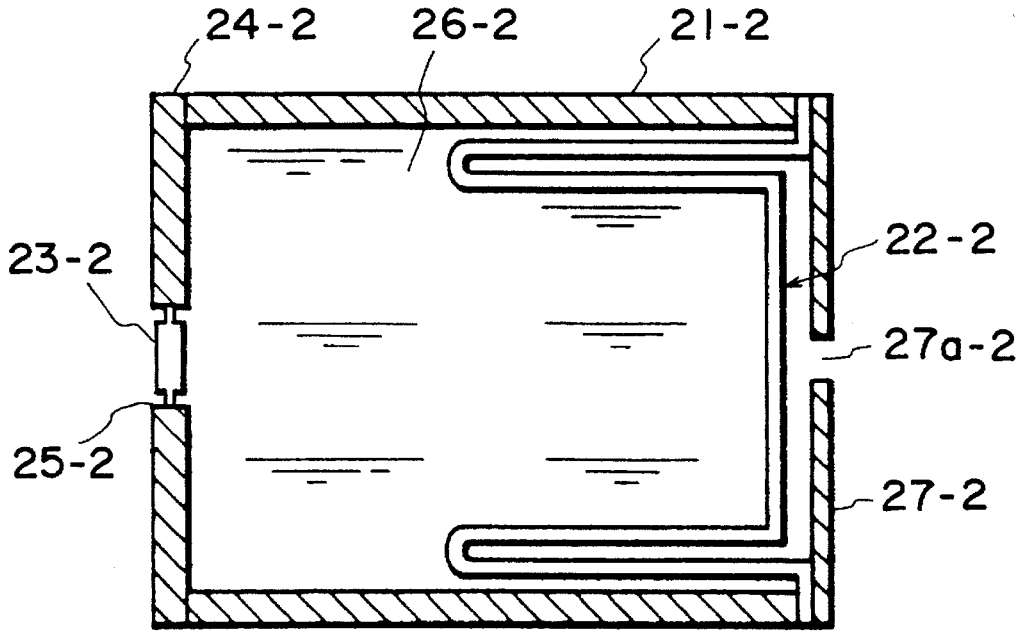
FIG. 8 is a sectional view of an ink container according to a second modification of the third embodiment.

In FIG. 8, the discharge opening 25-2 is closed by a tearable closing member 23-2 in place of the ball plug.

Figure 9:
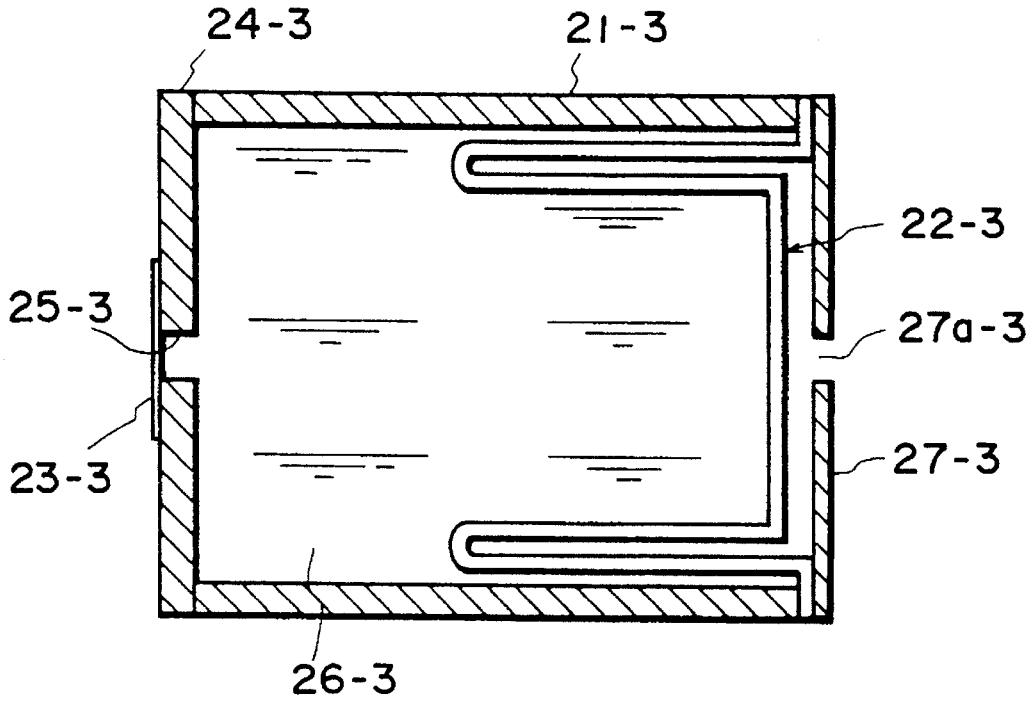
FIG. 9 is a sectional view of an ink container according to a third modification of the third embodiment.

In FIG. 9, the discharge opening 25-3 is closed by a sealing member 23-3 in the form of a film.

Figure 10:
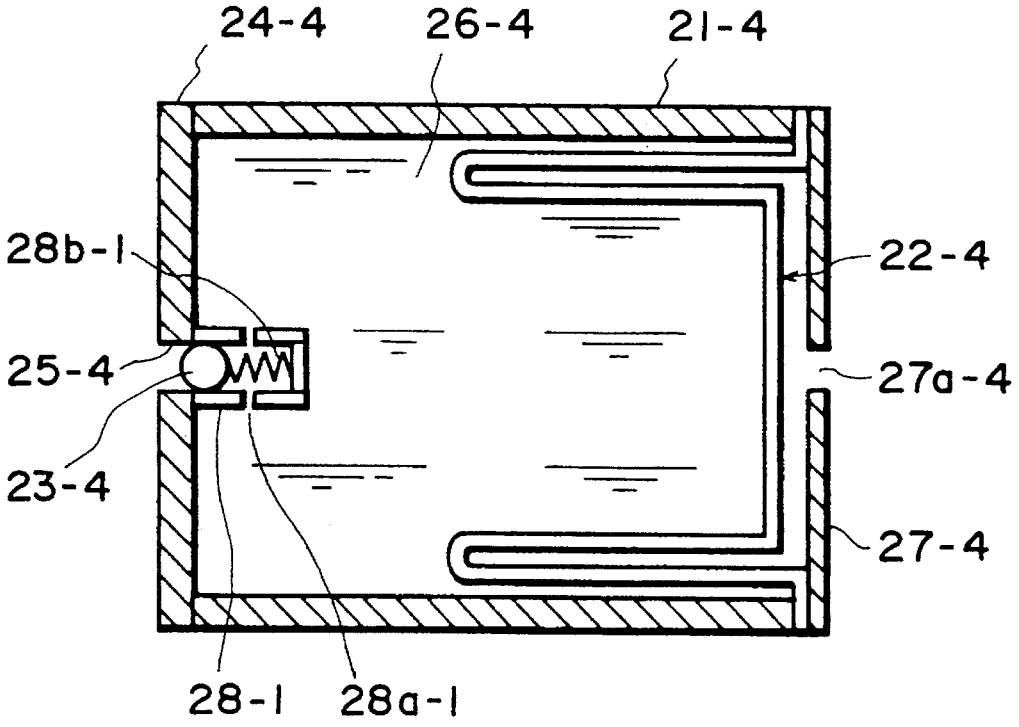
FIG. 10 is a sectional view of an ink container according to a fourth modification of third embodiment.

In FIG. 10, a ball guide 28-1 having an opening 28*a*-1 permitting passage of the ink is mounted to the bottom plate 24-4. Inside the ball guide 28, there is provided a compression spring 28*b*-1 to close the discharge opening 25-4 by the ball plug 23-4. In this modified embodiment, the discharge opening 25-4 may be opened by pushing the ball plug 23-4 against the spring force of the compression spring 28*b*-1 by proper means, when it is to be used. After the use, the discharge opening 25-4 may be closed when the pushing force is removed.

The description will be made as to the operation of the ink container.

Figure 11A:
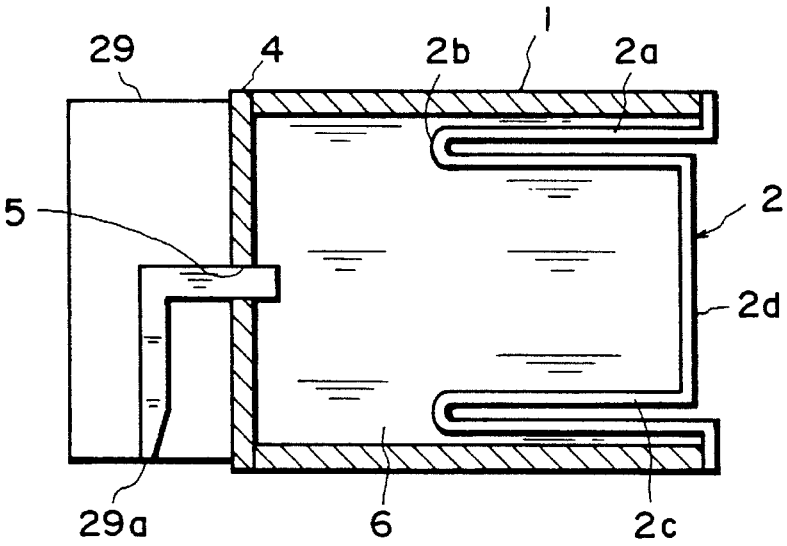
FIG. 11A shows the present invention at an initial stage of use.
Figure 11B:
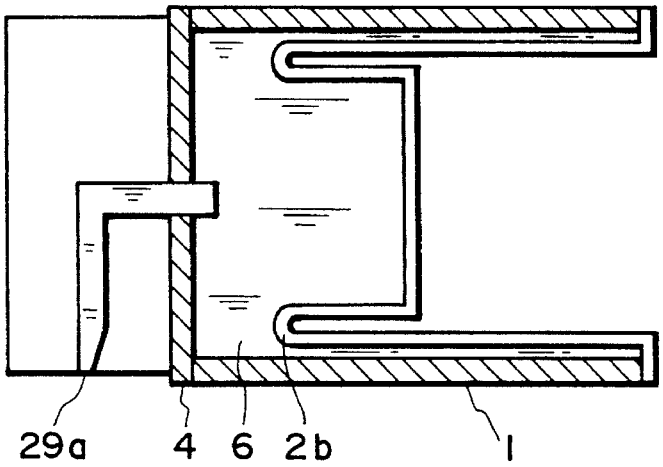
FIG. 11B shows the ink container at an intermediate stage of use.
Figure 11C:
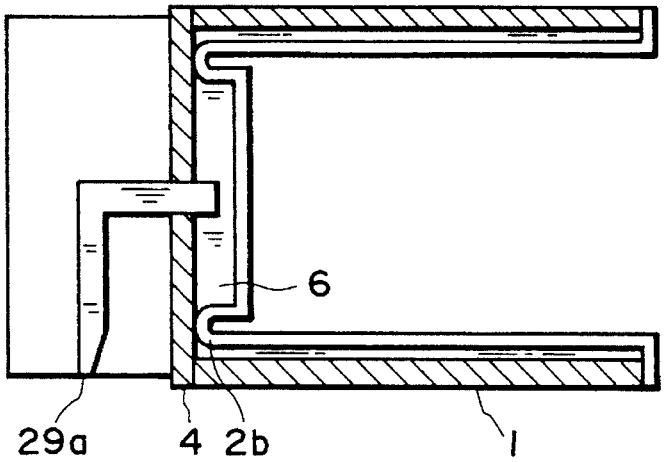
FIG. 11C shows the ink container at a final stage of use.

FIGS. 11A, 11B and 11C show the gradual consumption of the ink by the ejection of the ink 6 through an ejection outlet 29*a*, when it is mounted in a recording head 29 of the recording apparatus. The ink container is in the form of that of the first embodiment. FIG. 11A, 11B and 11C show the initial state, the intermediate state and the final state, respectively.

At the initial stage, as shown in FIG. 11A, the ball plug (not shown) is pushed by a rod or the like of the recording head 29 upon mounting to the recording head 29, so that the ball plug is removed from the discharge opening 3. This opens the discharge opening 3 to permit ink consumption through the ejection outlet 29*a*. With the consumption of the ink 6, the internal pressure of the ink container decreases with the result of production of the vacuum. The degree of the vacuum is enough to deform the flexible member 2. Therefore, the flexible member 2 deforms such that the bent portion 2*b* moves toward the bottom plate 4 along the internal surface of the outer cylindrical member 1. The bottom portion 2*d* does not move as easily as the outer and inner portions 2*a* and 2*c* of the cylindrical member. Therefore, it maintains the initial configuration, while moving toward the bottom plate 4. In this manner, the capacity of the ink container defined by the outer cylindrical member, bottom plate 4 and the flexible member 2, decreases by the amount of the ink consumed.

As shown in FIG. 11C, finally the bent portion 2*b* is brought into contact to the bottom plate 4. Then, the flexible member 2 can not deform any more, and the vacuum increases to such an extent to disable the ink supply. In usual use, the ink is not ejected any more.

As described in the foregoing, according to the embodiments of the present invention, the bent portion of the flexible member moves along the inner surface of the outer cylindrical member 1. Therefore, hardly any ink remains adjacent downstream side of the bottom portion, that is, the neighborhood of the inside surface of the bottom plate, during the consumption of the ink. In addition, since the bottom portion 2*d* reaches the bottom plate 4 while keeping the original shape, the ink can be consumed to the maximum extent.

As will be understood from the foregoing, the motion of the flexible member is along the internal surface, and therefore, the deformation of the flexible member does not restore, that is, it is difficult for the flexible member to spring back, and therefore, the deformation of the bent portion is irreversible. As compared with the prior art case relying on the elastic deformation of the flexible member, the restoration of the shape of the flexible member can be prevented. Therefore, the ink container does not suck thereinto the ambient air. This is advantageous because if it occurs, the ink supply is blocked by the air the bent portion and the outer portion of the flexible member may be closely contacted to or may be spaced apart from the internal surface of the outer cylindrical member.

Therefore, the dimensional accuracy of the flexible member is not required to be high. This makes the manufacturing steps for the ink container easier, and therefore, the cost thereof can be reduced.

The flexible member 2 used in this embodiment is preferably easily deformable and soft.

From the standpoint of keeping the nature of the ink, the materials of the ink container preferably satisfy:

(1) That they are free of plasticizer, or they do not adversely affect the ink.

(2) That they are free of surface active agent, or they do not adversely affect the ink.

(3) That they are free of heavy metal, that they do not adversely affect the ink.

(4) That they are high polymer having low moisture absorbing rate.

(5) That they are excellent in gas barrier nature.

(6) That they are high polymer having a glass transition point (Tg) lower than the room temperature.

(7) That they are high polymer not swollen or deformed by the ink.

(8) That they are weather proof and durable against ambient condition change.

(9) That they are high polymer capable of being processed to a thickness not more than 2 mm, preferably not more than 1 mm.

The materials exhibiting the glass transition point (Tg) lower than the room temperature, include fluorine rubber, PVC (polyvinyl chloride), PVA (polyvinylalcohol), PVdC (polyvinylidene chloride), PE (polyethylene), PP (polypropylene), polyolefin, EVA (ethylene vinyl acetate copolymer), polybutene, EPDM, EPR/EPT, butylchloride rubber, polyurethane, acrylic rubber, silicone rubber, BR (polybutadiene rubber), NBR (acrylonitrile butadiene rubber), SBR (styrene butadiene rubber), IR (isoprene rubber), IIR (isoprene isobutylene rubber), CR (chloroprene rubber), chlorosulfonic PE, polysulfide rubber.

The flexible member 2 may have a laminated structure having plural layers through provide desired properties sufficiently.

For example, a material exhibiting good gas barrier nature and a material exhibiting good sliding property between the outer cylindrical member of the container and the outer wall portion of the flexible member may be combined to provide the desired properties. As another example, the material of the most inner layer may be so selected as exhibit the good ink resistivity and good contactness with the liquid, or in view of the folding-back motion, a material exhibiting low frictional coefficient can be selected to permit smooth motion of the wall.

As a further example, the material may exhibit good gas-barrier nature to prevent evaporation of the ink and the introduction of gases, or a material exhibiting good shape retaining property with high flexibility such as rubber, is usable.

The rubber material preferably exhibits durability against long term use. The preferable rubber materials include IIR, butyl rubber, EPR, EPDM, EPT, fluorine rubber and thermoplastic elastomer.

On the other hand, the outer cylindrical member or the flexible member may be partly or entirely made of transparent or opaque material.

By the provision of the transparent or opaque portion, the user is permitted to become aware of the degree of use of the inside ink and the color of the inside ink, thus improving the operativity.

In this invention, particularly in the embodiment of FIG. 2, the inner wall portion 2*c* and the outer wall portion 2*a* may be brought into contact with each other.

If the friction therebetween is large, the motion of the bent portion 2*b* of the flexible member 2 is prevented with the result of disturbance to the ink supply.

To avoid this, it is preferable that lubricant material exist between the surfaces to reduce the friction force, or that the materials themselves exhibit good lubricancy.

Examples of the materials exhibiting the lubricant property include small particle size material such as glass beads, starch power, rolls or other powder materials.

Other examples include oil, non-volatile liquid, gel or zol material, wax.

Figure 12A:
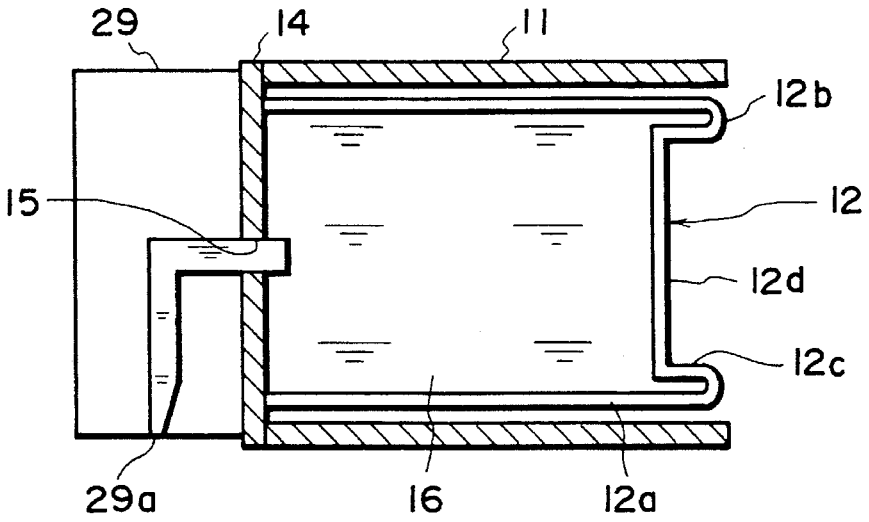
FIGS. 12A–12C, show another embodiment of the present invention at initial, intermediate and final stages of use, respectively.
Figure 12B:
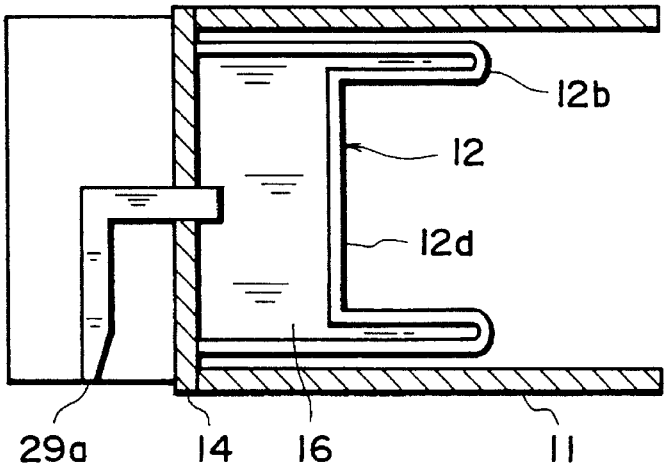
Figure 12C:
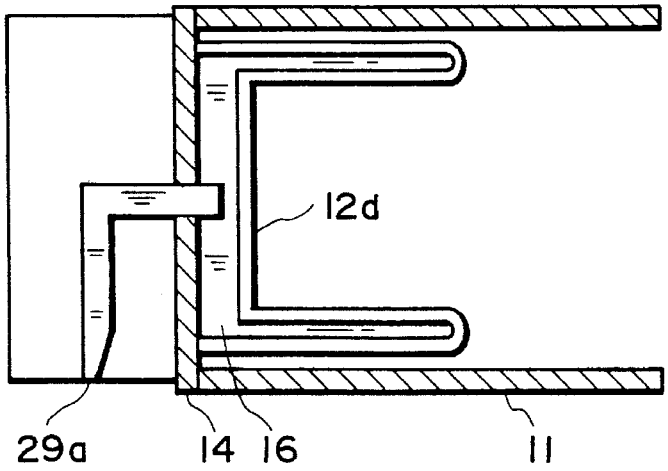

FIGS. 12A, 12B and 12C show the states of the ink container when the ink 16 is consumed through ejection outlets 29*a* when the ink container of the second embodiment shown in FIG. 5 is connected with a recording head 29. FIGS. 12A, 12B and 12C show an initial state, an intermediate state and a final state.

In the initial state, as shown in FIG. 12A, the ball plug (not shown) is spaced apart from the discharge outlet 15 upon coupling with the recording head 29, so that the discharge opening 5 is opened to permit supply of the ink 16 through the ejection outlets 29*a*.

With the consumption of the ink 16 in the ink container, the internal pressure of the ink container decreases to produce a vacuum. As shown in FIG. 12B, the vacuum deforms the flexible member 12, so that the bent portion 12*b* moves along the internal wall surface of the outer cylindrical member 11 toward the bottom plate 14 thereof. The bottom portion 12*d* does not deform as easily as the outer wall portion 12*a* and the inner wall portion 12*c*, and therefore, it moves toward the bottom plate 14 while maintaining the initial configuration. Thus, the ink container capacity defined by the outer cylindrical member 11, the bottom plate 14 and the flexible member 12, reduces by the amount corresponding to the ink consumption.

As shown in FIG. 12C, at the final stage, the resilient force of the flexible member 12 and the vacuum reach balance, so that the ink is not discharged any more in the usual use.

In this embodiment, the deformation of the flexible member 12 is also irreversible, so that the introduction of the air into the container can be prevented.

FIGS. 13, 14, 15 and 16 show other embodiments, in which the configuration of the flexible member is different from that of the first embodiment. Therefore, the description is made only as to the flexible member, and the description of the other parts and operations are omitted for simplicity.

Figure 13:
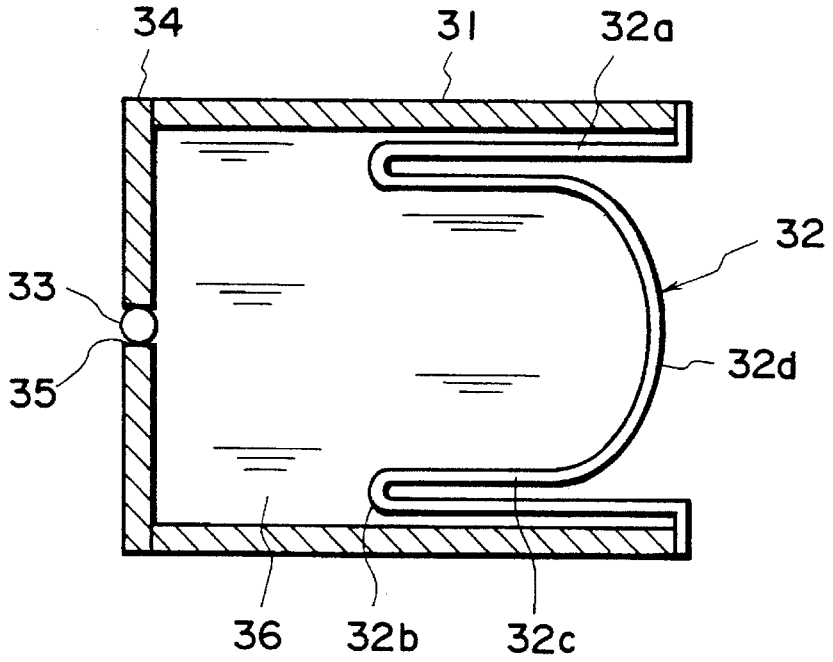
FIG. 13 is a sectional view of an ink container according to a fourth embodiment of the present invention.

FIG. 13 shows a fourth embodiment, in which the bottom portion 32*d* of the flexible member 32 is semi-spherical. With this configuration, the bottom wall portion 32*d* reverses in the semi-spherical shape to become convex toward the discharge outlet in the final stage of the ink consumption, and therefore, the ink supply efficiency is further improved.

Figure 14:
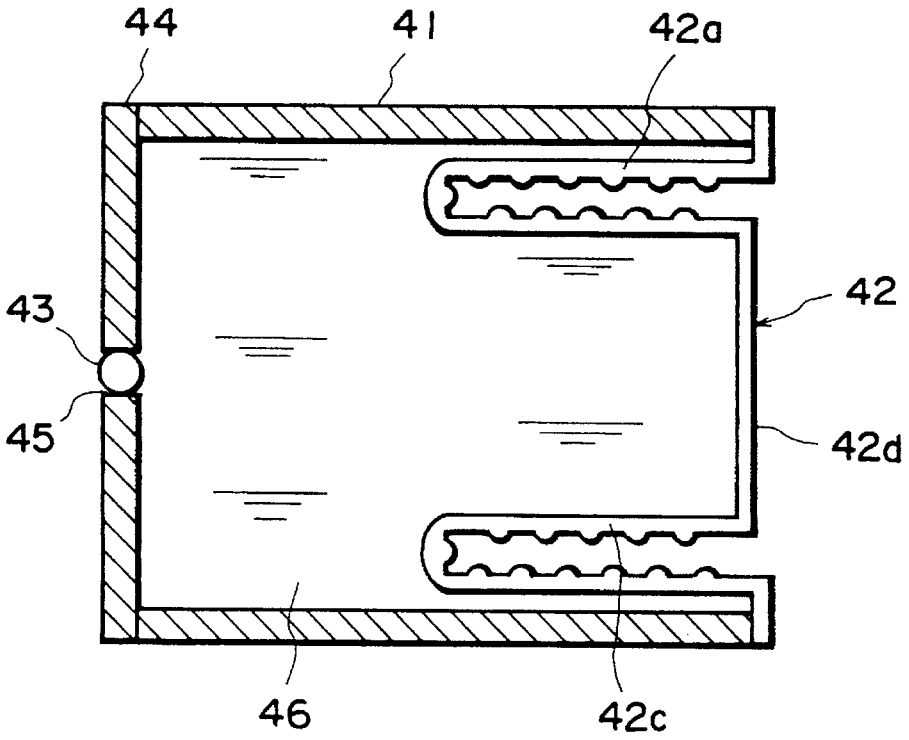
FIG. 14 is a sectional view of an ink container according to a fifth embodiment of the present invention.

FIG. 14 shows a fifth embodiment wherein the outer wall portion 42*a* and the inner wall portion 42*c* of the flexible member 42 are provided with pits and projections.

Due to the uneven thickness of the flexible member wall, the vacuum provided by the flexible member can be adjusted, and the contact between the outer wall portion 42*a* and the inner wall portion 42*c* can be improved. In addition, it is possible to reduce the friction coefficient.

Figure 15:
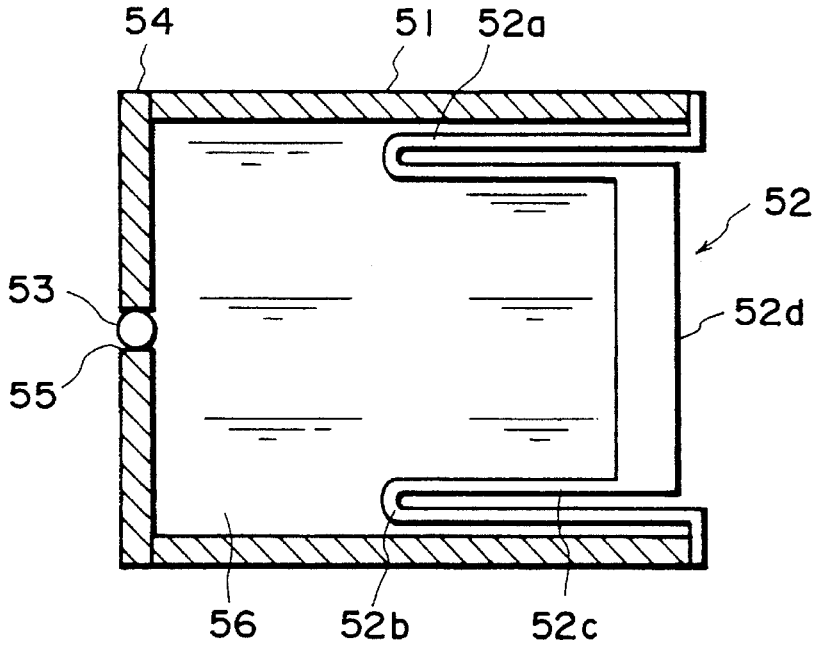
FIG. 15 is a sectional view of an ink container according to a sixth embodiment of the present invention.

FIG. 15 shows a sixth embodiment wherein the bottom wall portion 52*d* of the flexible member 52 is made thicker than the outer wall portion 52*a* and the inner wall portion 52*c*. In this embodiment, the bottom wall portion 52*d* becomes more difficult to deform, so a further stabilized operation is possible.

The outer cylindrical member may be in the form of a circular cylinder, or rectangular or square cylinder.

Figure 16:
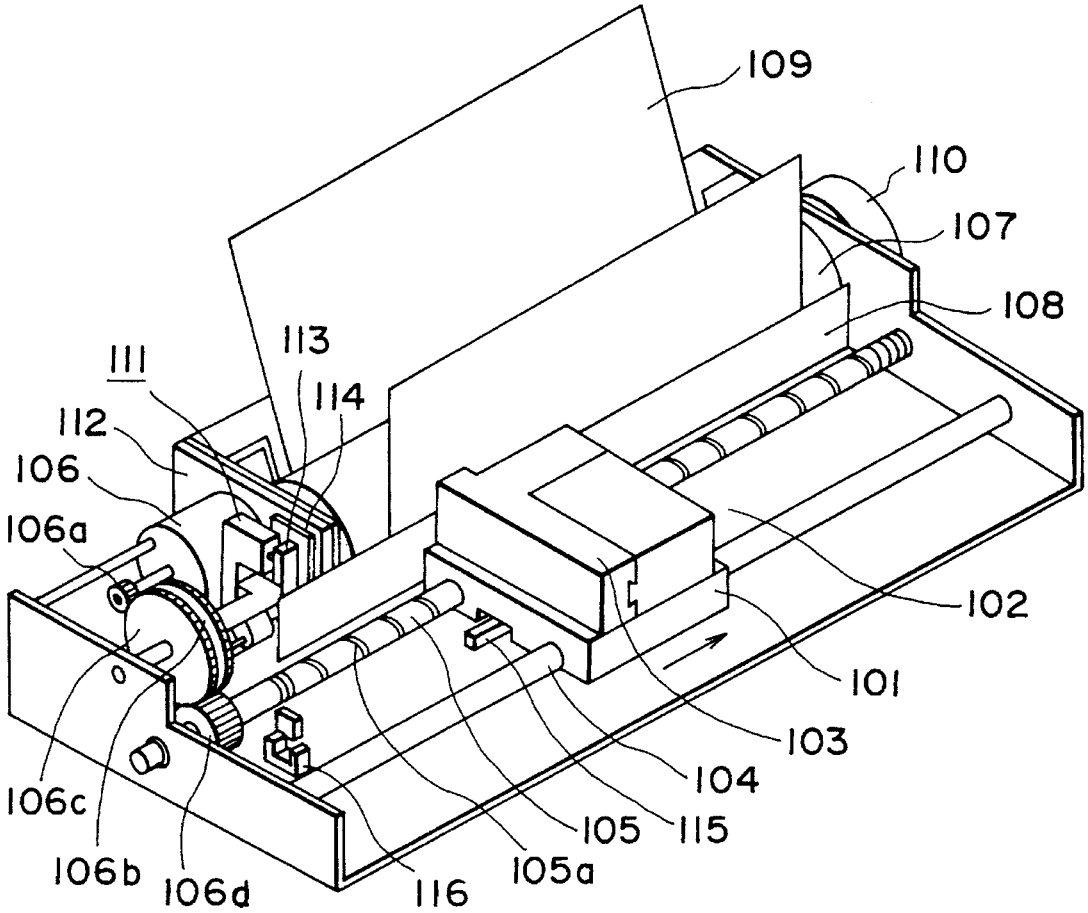
FIG. 16 is a perspective view of an example of ink jet recording apparatus using an ink container according to an embodiment of the present invention.

Referring to FIG. 16, the description will be made as to an ink jet recording apparatus using the ink container according to this invention.

A carriage 101 carries a recording head unit having combined recording head 103 and ink container according to an embodiment of the present invention. The carriage 101 is guided along a guiding shaft 104 and is driven by a lead screw 105 having a helical groove 105*a*. On the carriage 101, an ink container cassette 102 having an ink container according to this invention, can be mounted. The recording head 103 is provided with an unshown rod, which is inserted into the discharge opening 5 of the container 1 to push the ball 5 upon unification of the ink container cassette 102 with the recording head, by which the discharge opening 5 is opened.

The lead screw 105 is rotated in the forward and backward direction through gear trains 106*a*, 106*b*, 106*c* and 106*d* from a reversible driving motor 106. By this, the carriage 101 is reciprocated in the direction indicated by arrows through a pin (not shown) of the carriage 101 engaged with the lead screw 105*a*. The switching between the forward and backward rotations of the driving motor 106, is carried out upon detection of the home position of the carriage 101 by a lever 115 of the carriage 101 and a photocoupler 116.

On the other hand, a recording sheet 109 is pressed on a platen 107 by a pressing plate 108, and is fed by a sheet feeding roller (not shown) driven by a sheet feeding motor 110, so as to be faced to the recording head.

A recovery unit 111 is provided to recover the proper ejection of the recording head by removing foreign matter or high viscosity ink deposited on the ejection outlet side surface of the recording head.

The recovery unit 111 comprises a capping member 113 in communication with sucking means (not shown). The ink is sucked through the ejection outlets while the outlets are capped by the capping member 113 by which the foreign matter and/or the high viscosity ink deposited on the ejection outlet side surface of the recording head 103 is removed. Between the recovery unit 111 and the platen 107, there is disposed a cleaning blade 114 which is guided by a guiding member 112 for advancement and retraction relative to a movement path of the ejection side surface of the recording head 103. By the edge of the cleaning blade 114, the foreign matter and ink droplets deposited on the ejection side surface of the recording head can be removed.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressurizing or suction means, preliminary heating means which may be the electrothermal transducer, an additional heating element or a combination thereof. Also, means for effecting preliminary ejection (not for the recording operation) can stabilize the recording operation.

As regards the type of the recording head mountable, it may be a head corresponding to a single head color ink, or may be plural head corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the flexible member has a bent portion movable along the internal surface of an outer cylindrical member, and irreversibly deforms, so that the volume of the ink container decreases in accordance with very small pressure change resulting from consumption of the ink and that the configuration thereof is maintained when the ink is not consumed. As a result, the introduction of the air into the ink container is effectively prevented, thus improving the reliability of the recording apparatus.

While the invention has been described with reference to the structures disclosed herein, it is not confined to the details set forth and this application is intended to cover such modifications or changes as may come within the purposes of the improvements or the scope of the following claims.

What is claimed is:

1. An ink container comprising:

a cylindrical member having a closed end, an opposite open end and an internal surface, said cylindrical member further having an ink supply port for allowing ink to be consumed; and an elastic member, having cross-section of a size substantially equal to a cross-section of said cylindrical member, and including a side portion extending along the internal surface of said cylindrical member and a bottom portion opposed to the closed end of said cylindrical member, wherein an open end of said elastic member is fixed to said cylindrical member to cover the open end of said cylindrical member to define an ink containing portion;

wherein the side portion of said elastic member has a bent-back portion, which, when the ink containing portion is full, is effective to position the bottom portion of said elastic member adjacent the open end of said cylindrical member, and is bent back along the internal surface of said cylindrical member, and the bent-back portion and the bottom portion, which is less easily deformable than the bent-back portion, are movable along the internal surface in response to an internal pressure reduction caused by consumption of ink through said ink supply port, wherein the bent-back portion and the bottom portion maintain a substantially constant negative pressure in said ink containing portion regardless of a position of the bottom portion.

2. An ink container according to claim 1, wherein an outer surface of the side portion of said flexible member is lubricated.

3. An ink container according to claim 1, wherein said flexible member has a peripheral edge, and said open end of said cylindrical member has an end surface, and said peripheral edge is fixed to said end surface of the open end of said cylindrical member.

4. An ink container according to claim 1 wherein said flexible member has a peripheral edge, and said closed end of said cylindrical member has a bottom portion, and said peripheral edge is fixed to said bottom portion at the closed end of said cylindrical member.

5. An ink container according to claim 1, wherein the open end of said cylindrical member is covered by a cap having an air vent, and said flexible member is disposed in a space defined by said cylindrical member and said cap.

6. An ink container according to claim 1, further comprising closing means for closing the ink supply port of said cylindrical member.

7. An ink container according to claim 6, further comprising means provided on an inside surface of said ink container enclosing the ink supply port for biasing said closing means to close the ink supply port.

8. An ink container according to claim 4, further comprising bonding means for bonding the side portion of said flexible member and the internal surface of said cylindrical member with a bonding strength that is low enough to permit unbonding as a result of a predetermined pressure reduction because of consumption of the ink.

9. A recording head unit comprising:

an ink container including a cylindrical member having a closed end, an opposite open end and an internal surface, said cylindrical member further having an ink supply port for allowing ink to be consumed; and an elastic member, having cross-section of a size substantially equal to a cross-section of said cylindrical member, and including a side portion extending along the internal surface of said cylindrical member and a bottom portion opposed to the closed end of said cylindrical member, wherein an open end of said elastic member is fixed to said cylindrical member to cover the open end of said cylindrical member to define an ink containing portion; wherein the side portion of said elastic member has a bent-back portion, which, when the ink containing portion is full, is effective to position the bottom portion of said elastic member adjacent the open end of said cylindrical member, and is bent back along the internal surface of said cylindrical member, and the bent-back portion and the bottom portion, which is less easily deformable than the bent-back portion, are movable along the internal surface in response to an internal pressure reduction caused by consumption of ink through said ink supply port, wherein the bent-back portion and the bottom portion maintain a substantially constant negative pressure in said ink containing portion regardless of a position of the bottom portion; and a plurality of ejection outlets through which the ink is ejected by ejection energy generating means for ejecting the ink and a liquid passage which provided fluid communication between the ink supply port of said ink container and said ejection outlets.

10. A recording apparatus comprising:

a recording head unit including an ink container including a discharge outlet, a cylindrical member having a closed end, an opposite open end and an internal surface, said cylindrical member further having an ink supply port for allowing ink to be consumed, an elastic member, having a cross-section of a size substantially equal to a cross-section of said cylindrical member, and including a side portion extending along the internal surface of said cylindrical member and a bottom portion opposed to the closed end of said cylindrical member, wherein an open end of said elastic member is fixed to said cylindrical member to cover the open end of said cylindrical member to define an ink containing portion, wherein the side portion of said elastic member has a bent-back portion, which, when the ink containing portion is full, is effective to position the bottom portion of said elastic member adjacent the open end of said cylindrical member, and is bent back along the internal surface of said cylindrical member, and the bent-back portion and the bottom portion, which is less easily deformable than the bent-back portion, are movable along the internal surface in response to an internal pressure reduction caused by consumption of ink through said ink supply port, wherein the bent-back portion and the bottom portion maintain a substantially constant negative pressure in said ink containing portion regardless of a position of the bottom portion;

a plurality of ejection outlets through which the ink is ejected by ejection energy generating means for ejecting the ink;

a liquid passage which provided fluid communication between the ink supply port of said ink container and said ejection outlets;

supply means for supplying an electric signal to said energy generating means;

a carriage for carrying said recording head unit; and feeding means for feeding a recording material oriented so as to face said recording head so that the ink ejected from said ejection outlets is deposited on said recording material.

* * * * *

UNITED STATES PATENT AND TRADEMARK OFFICE

CERTIFICATE OF CORRECTION

PATENT NO. : 5,608,437

DATED : March 4, 1997

INVENTOR(S) : KAZUO IWATA ET AL.

It is certified that error appears in the above-identified patent and that said Letters Patent is hereby corrected as shown below:

COLUMN 2

Line 43, "That is" should read --That is,--.

COLUMN 3

Line 25, "Used" should read --used--.
Line 53, "a or" should read --a bent or--.
Line 59, "an" should read --a--.

COLUMN 4

Line 13, "open end of the" should be deleted.
Line 14, "neighborhood" should read --neighborhood of the open end--.
Line 31, "move" should read --to move--.
Line 58, "embodiment" should read --embodiments-- and "embodiments." should read --embodiment.--.

COLUMN 5

Line 44, "to" should read --with--.
Line 52, "downstream" should read --the downstream--.

COLUMN 6

Line 46, "through provide" should read --to provide the--.
Line 53, "exhibit" should read --to exhibit--.
Line 54, "contactness" should read --contact--.

UNITED STATES PATENT AND TRADEMARK OFFICE

CERTIFICATE OF CORRECTION

PATENT NO. : 5,608,437

DATED : March 4, 1997

INVENTOR(S) : KAZUO IWATA ET AL.

It is certified that error appears in the above-identified patent and that said Letters Patent is hereby corrected as shown below:

COLUMN 7

Line 19, "power," should read --powder,--.
Line 20, "zol" should read --sol--.

COLUMN 9

Line 64, "a head" should read --a single head-- and "head" (second occurrence) should be deleted.
Line 65, "head" should read --heads--.

COLUMN 10

Line 43, "very" should read --a very--.
Line 60, "cross-section" should read --a cross-section--.

COLUMN 11

Line 25, "claim 1" should read --claim 1,--.
Line 52, "cross-section" should read --a cross-section--.

UNITED STATES PATENT AND TRADEMARK OFFICE

CERTIFICATE OF CORRECTION

PATENT NO. : 5,608,437

DATED : March 4, 1997

INVENTOR(S) : KAZUO IWATA ET AL.

It is certified that error appears in the above-identified patent and that said Letters Patent is hereby corrected as shown below:

COLUMN 12

Line 15, "provided" should read --provides--.
Line 50, "provided" should read --provides--.

Signed and Sealed this

Seventh Day of October, 1997

*Attest:*

*Attesting Officer*

BRUCE LEHMAN

*Commissioner of Patents and Trademarks*